US005225143A

United States Patent [19]

Labate, II et al.

[11] Patent Number: 5,225,143

[45] Date of Patent: Jul. 6, 1993

[54] DEVICE FOR DIRECTIONAL GAS DISTRIBUTION INTO MOLTEN METAL

[75] Inventors: Michael D. Labate, II, East Palestine; Victor D. Garcia, Youngstown; Dallas F. Mansell, Jr., East Palestine, all of Ohio

[73] Assignee: Insul Company, Inc., East Palestine, Ohio

[21] Appl. No.: 717,351

[22] Filed: Jun. 18, 1991

Related U.S. Application Data

[63] Continuation-in-part of Ser. No. 649,551, Feb. 1, 1991, abandoned.

[51] Int. Cl.[5] ..... C21C 5/48

[52] U.S. Cl. ..... 266/220; 266/270

[58] Field of Search ..... 266/220, 270

[56] References Cited

U.S. PATENT DOCUMENTS

| | | | |
|---|---|---|---|
| 4,340,208 | 7/1982 | Vayssiere et al. | 266/220 |
| 4,396,179 | 8/1983 | LaBate | 266/220 |
| 4,483,520 | 11/1984 | LaBate | 266/220 |
| 4,535,975 | 8/1985 | Buhrmann et al. | 266/220 |
| 4,538,795 | 9/1985 | LaBate | 266/220 |
| 4,568,066 | 2/1986 | Grabner et al. | 266/220 |
| 4,632,367 | 12/1986 | LaBate | 266/220 |
| 4,687,184 | 8/1987 | LaBate et al. | 266/270 |
| 4,725,047 | 2/1988 | LaBate | 266/270 |
| 4,836,433 | 6/1989 | Perri | 266/266 |
| 4,840,356 | 6/1989 | LaBate | 266/265 |
| 4,858,894 | 8/1989 | LaBate | 266/265 |

*Primary Examiner*—Melvyn J. Andrews
*Attorney, Agent, or Firm*—Harpman & Harpman

[57] ABSTRACT

A solid non-permeable pocket block for incorporation in a normal refractory lining of a ladle or other metallurgical vessel is provided with a plurality of passageways through which gas, such as argon, can be introduced into molten metal in a ladle or the like in desirable stirring and protective patterns.

5 Claims, 2 Drawing Sheets

DEVICE FOR DIRECTIONAL GAS DISTRIBUTION INTO MOLTEN METAL

This is a continuation-in part of pending patent application Ser. No. 07/649,551 filed Feb. 1, 1991 now abandoned.

BACKGROUND OF THE INVENTION

1. Technical Field

This invention relates to devices for insufflating gas into a mass of molten metal.

2. Description of the Prior Art

Prior structures of this type have generally employed pocket blocks having frusto-conical openings therethrough in which frusto-conical plugs having similarly shaped metal shells thereabout are positioned so as to form an annular passageway upwardly through the opening in the pocket block. Such constructions are shown in the following LaBate-Insul Company U.S. Pat. Nos. 4,396,179, 4,483,520, 4,538,795, 4,632,367, 4,687,184, 4,725,047, and 4,840,356.

Additionally, U.S. Pat. No. 4,568,066 to Grabner illustrates a version of the conventional pocket block and plug apparatus.

LaBate-Insul Company Patents 4,836,433 and 4,858,894 disclose pocket blocks and/or their equivalents in which gas conducting passageways are directly formed and U.S. Pat. No. 4,535,975 to Buhrmann, et al. discloses a gas transmitting wall element in which a refractory brick is provided with a plurality of longitudinally extending grooves in the vertical sides thereof and encased in a metal box so that the grooves define passageways on the outer surfaces of the brick.

The present invention comprises a pocket block having a superior arrangement of interconnecting small gas conveying passageways formed therein by a novel method resulting in an unusually efficient pattern of upwardly and horizontally extending passageways individually capable of producing small jets and bubbles of pressurized gas in a bath of molten metal, the passageways being so formed provide for equalization of the gas pressure over the block's top and side surfaces diminishing uneven erosion of the block, thus enhancing its performance and usual life.

SUMMARY OF THE INVENTION

A pocket block having a novel formation of gas conveying passageways therein provides an unusually effective pattern of gas jets and bubbles in a bath of molten metal due to the interconnection of the gas passageways in the pocket block and their desirably positioned outlets in the top and side surfaces of the pocket block whereby the gas jets stir the molten metal and the gas bubbles protect the sides and top molten metal engaging surfaces thereof. The plurality of interconnected passageways in the improved pocket block of the invention are formed by embedding a network of interconnecting flexible synthetic resin filaments or small cords in the refractory of the pocket block as it is being formed and provide a gas manifold at the lower end of the network by initially positioning a wax or synthetic resin body in a cup so as to establish a communicating manifold with the network of interconnected flexible synthetic resin filaments extending upwardly and horizontally through the pocket block and firing the pocket block to a temperature necessary to melt the synthetic resin filaments and/or the cords and the wax block to form a manifold communicating therewith. A gas supply pipe communicates with the cup and the manifold and extends outwardly of the lower surface of the pocket block and through the bottom or the desired wall of the ladle or vessel.

DESCRIPTION OF THE PREFERRED EMBODIMENT

Figure 1:
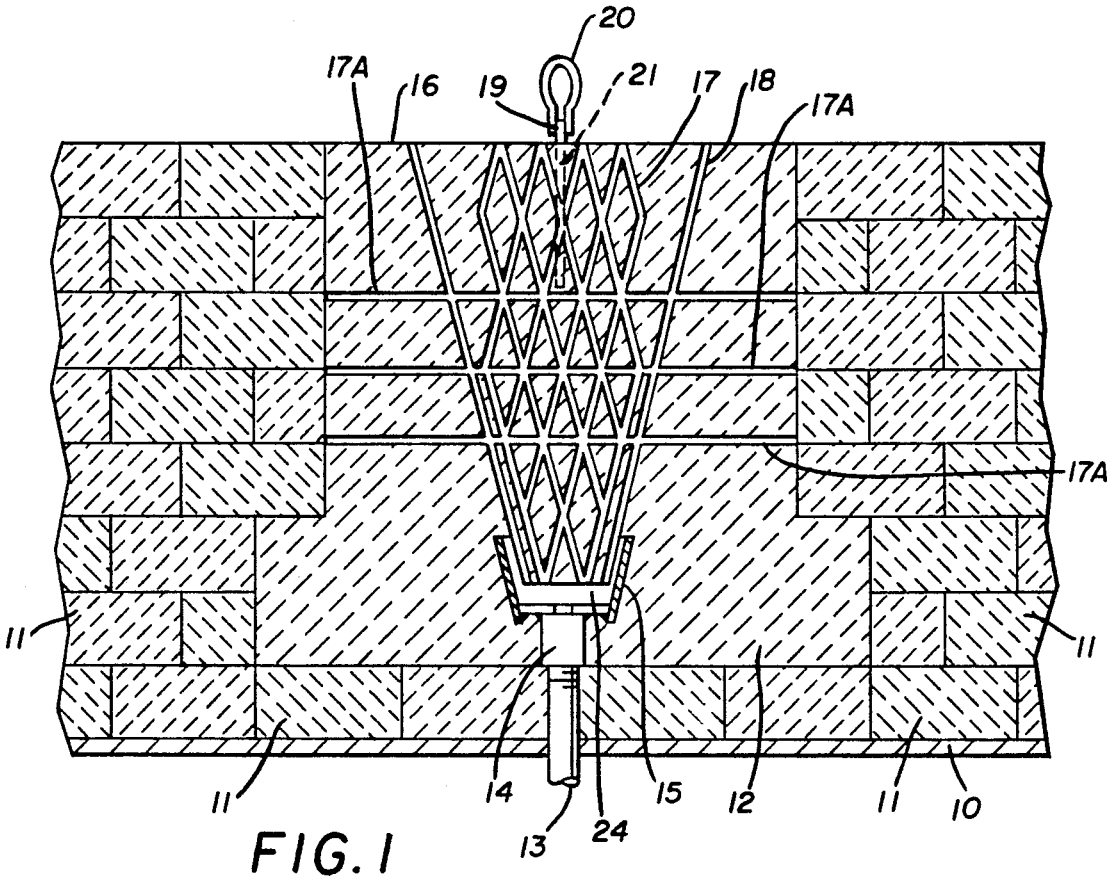
FIG. 1 is a vertical section through the improved pocket block with its network of intercommunicating small passageways illustrated in enlarged detail.

By referring to FIG. 1 of the drawings, a bottom (or other wall) of a ladle or other vessel for molten metal is illustrated at 10 together with refractory lining units 11 and a pocket block 12. A pipe 13 extends upwardly through an opening in the bottom of the ladle 10 and through an opening in the refractory lining 11 and communicates with an opening 14 in the bottom of the pocket block which may be defined by a resin, ceramic or metallic pipe which communicates with a resin, ceramic or metallic cup 15 by way of an aperture in the bottom thereof. Spaced thereabove communicating with the cup 15 and extending upwardly and outwardly to the upper and side surfaces 16 and 16A of the pocket block 12 there are a plurality of small interconnecting passageways 17 and 17A and preferably one or more individual upwardly extending passageways 18. The passageways 17 and 18 terminate above the apertured bottom of the cup 15 and all of which extend to the upper surface 16 of the pocket block 12. The interconnecting passageways 17A extend to the side surfaces 16A of the pocket block 12. Preferably, but not necessarily, an anchor 19 with a loop 20 on its upper end is positioned in the pocket block 12 to form a pickup hook. A refractory erosion visual indicator 21, such as disclosed in LaBate-Insul U.S. Pat. No. 4,744,544, is preferably embedded in the pocket block 12.

Figure 3:
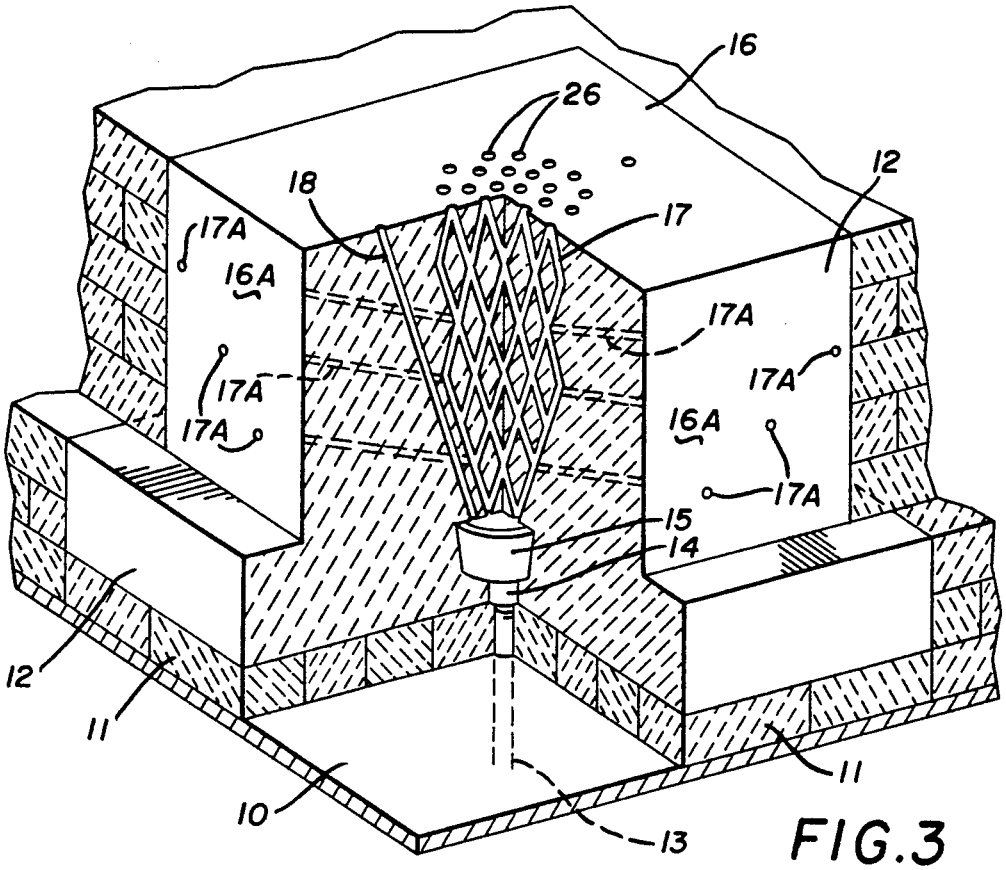
FIG. 3 is a perspective view of a portion of a pocket block with parts broken away and parts in cross section illustrating in exaggerated enlarged detail the network of interconnecting passageways formed therein.
Figure 4:
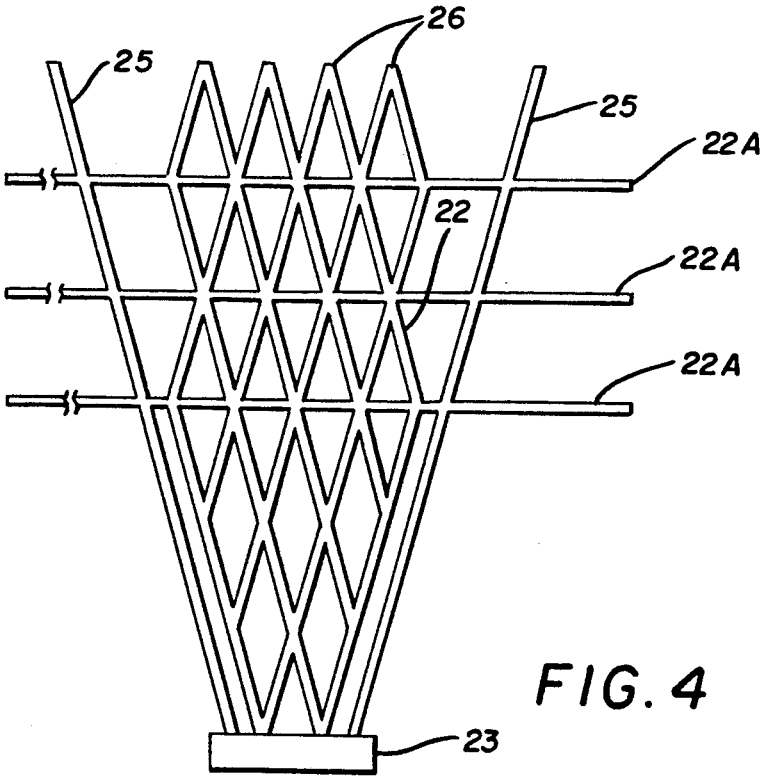
FIG. 4 is an enlarged side view of a network of interconnecting members formed of synthetic resin filaments or cords in a preferred shape to be embedded in a pocket block and melted or burned and removed therefrom forming passageways as illustrated in FIGS. 1, 2, and 3 of the drawings.

In order to form the network of interconnected gas conveying passageways 17 and 17A, a desirably shaped consumable or meltable synthetic resin network of flexible shape retaining filaments or cords 22 and 22A are provided as best shown in FIG. 4 of the drawings, the shape illustrated being exaggerated as to the thickness of the synthetic resin filaments 22 and the network desirably shaped, as for example in upstanding circular configuration with transverse portions is positioned in the pocket block 12 as it is formed of a suitable refractory. For example, as shown in FIG. 1 of the drawings, the pipes 13 and 14 and the cup 15 are supported in a mold, not shown, a block of wax 23 as seen in FIG. 4 is positioned in the cup 15 in the space in which a manifold 24 is to be formed and the desirably shaped network of synthetic resin filaments 22 is positioned on the block of wax 23 so that it extends upwardly to the level of the upper surface 16 and sidewardly to the sides of the pocket block to be formed thereabout so as to form the passageways 17 and 17A therein. Additional resin filaments 25, preferably straight as seen in FIG. 4, are positioned in the cup 15 in the mold, not shown, so as to form the individual passageways 18 as seen in FIG. 1 of the drawings. The refractory is then added to form the pocket block as seen in FIGS. 1 and 3 of the drawings with the desirably shaped network of interconnected synthetic resin filaments 22 and 22A and if desired the individual synthetic resin filaments 25 and the block of wax 23 which can alternately be formed of synthetic resin are thus completely embedded in the refractory of which the pocket block 12 is formed. The pocket block with its embedded filaments and the cup 15 and pipe 14 is then removed from the mold and fired to an appropriate temperature to create a desired ceramic which will resist wear of molten metal supported thereby and of a temperature sufficient to liquify or consume the network of interconnected synthetic resin filaments 22, 22A & 25 as well as the block of wax 23 or synthetic resin, as the case may be. The liquified or combustable resin and/or wax drain or burn out of the refractory block and leave the desirable pattern of small interconnected passageways 17 and 17A therein communicating with a manifold 24 as formed when the block of wax 23 (or resin) liquify or are consumed.

It will occur to those skilled in the art that the size of the filaments 22, 22A & 25 can be varied to produce the desired small and/or very small and/or extremely small passageways 17 and 17A and 18 as seen in FIGS. 1 and 3 of the drawings and that the cup 15 and the pipe 14 may also be formed of synthetic resin which will melt and drain away or be consumed simultaneously with the filaments 22, 22A & 23 so as to leave the desired arrangement of manifold and passageways in the pocket block thus formed.

Figure 2:
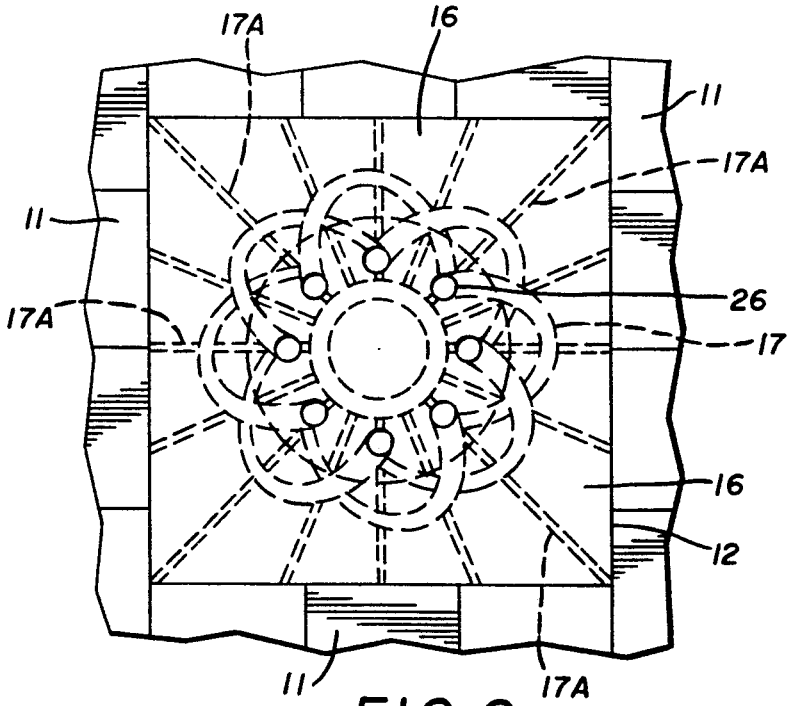
FIG. 2 is a top view of a modified pocket block with greatly enlarged broken line representations of spiral and straight interconnecting passageways formed therein.

It will occur to those skilled in the art that the desirably shaped network of interconnecting synthetic resin filaments 22 may be shaped in a number of configurations, for example in a spiral as shown in broken lines in a top plan view of FIG. 2 of the drawings, and representing an alternate shape to that in FIG. 1 of the drawings and that the pattern of small or extremely small openings 26 in the upper surface 16 of the pocket block 12 which represent the upper ends of the passageways 17 are thus capable of being arranged in any desired pattern at any desired angle from vertical so that a desired stirring pattern of gas jets and gas bubbles can be achieved with the invention herein disclosed and the method of forming the device of the invention.

It will thus be seen that a novel pocket block for use in directing gas into a molten metal bath has been disclosed together with a method of forming the same and it will be observed that the use of a network of filaments or cords of synthetic resin or combustible materials enables the member thus formed to be of any desired size and shape so that the interconnecting passageways 17 and 17A which deliver the gas to the molten metal may be of any desired design or shape and the diameter of the passageways controlled so that a pocket block with a specific desired configuration of the gas conveying passageways may be formed wherein the gas jets and bubbles formed in the molten metal bath by the gas flowing through the passageways can be arranged to result in the most efficient swirling and block penetrating pattern possible.

It will be apparent to those skilled in the art that other consumable materials can be substituted for synthetic resin filaments 22 wherein a filament web-like construction can be achieved by placing interconnecting and/or overlapping combustible strands such as cordage, cellulose based fiber compounds and carbon fibers so as to form the preferred interconnecting passage-ways 17 and 17A upon combustion.

Although but one embodiment of the present invention has been illustrated and described, it will be apparent to those skilled in the art that various changes and modifications may be made therein without departing from the spirit of the invention and having thus described our invention,

What we claim is:

1. A pocket block for introducing gas into a mass of molten metal in a vessel having a refractory lining, the pocket block forming part of said lining and comprising: a body member of refractory material having a lower surface and an upper surface and side surfaces, said upper and side surfaces being positioned for engagement with said molten metal, a plurality of passageways in said body member extending inwardly thereof from said upper surface and communicating with a manifold in said body member below said passageways, said passageways being interconnected to one another above said manifold inwardly from said upper surface and inwardly from said side surfaces, said passageways being arranged in a weblike formation with some of said passageways extending in a first direction and others of said passageways extending in a second direction, said passageways being connected to each other at locations that are spaced from said manifold, said weblike formation of passageways causing gas flowing therethrough to exit therefrom in a plurality of streams of stirring gas and protective bubbles rising in said molten metal when gas is introduced through said passageways so that swirling stirring motion is imparted to said molten metal and said bubbles move molten metal upwardly away from said pocket block.

2. The pocket block set forth in claim 1 wherein the refractory material is solid.

3. The pocket block set forth in claim 1 wherein the refractory material is ceramic.

4. The pocket block set forth in claim 1 and wherein said plurality of passageways are defined by forming said pocket block with an interconnecting network of heat removable filaments embedded within a solid pocket block, a heat removable member engaging said heat removable filaments, a supply passageway communicating with said member and extending through said registering openings in said body member and said vessel whereby said heat removable member forms a manifold in said solid pocket block connecting said interconnecting passageways with said supply passageway.

5. The pocket block set forth in claim 4 and wherein said heat removable filaments are of various cross sectional shapes and sizes whereby the cross sectional shapes and sizes of said plurality of interconnecting passageways in said pocket block are of the same cross sectional shapes and sizes as said filaments when said network of filaments are removed by heating said pocket block.

* * * * *